United States Patent [19]

Ragland, Jr.

[11] 4,437,036

[45] Mar. 13, 1984

[54] CATHODE-RAY TUBE HAVING A TEMPERATURE COMPENSATED MASK-FRAME ASSEMBLY

[75] Inventor: Frank R. Ragland, Jr., Lancaster, Pa.

[73] Assignee: RCA Corporation, New York, N.Y.

[21] Appl. No.: 314,383

[22] Filed: Oct. 23, 1981

[51] Int. Cl.[3] ..... H01J 29/80

[52] U.S. Cl. ..... 313/402; 313/407

[58] Field of Search ..... 313/402, 404, 33, 405, 313/406, 407, 408, 403, 482, 477 R

[56] References Cited

U.S. PATENT DOCUMENTS

| | | | |
|---|---|---|---|
| 2,795,718 | 6/1957 | van Hekken | 313/85 |
| 2,795,719 | 6/1957 | Morrell | 313/85 |
| 3,368,098 | 2/1968 | Demmy | 313/85 |
| 3,703,401 | 12/1970 | Deal | 313/85 |
| 3,772,555 | 11/1973 | McKee et al. | 313/85 S |
| 3,803,436 | 4/1974 | Morrell | 313/85 S |
| 3,823,336 | 7/1974 | Nakamura et al. | 313/405 |
| 3,855,493 | 12/1974 | Snook et al. | 313/402 |
| 3,872,345 | 3/1975 | Yamazaki et al. | 313/403 |
| 3,931,540 | 1/1976 | Kawamura | 313/404 |
| 4,164,682 | 8/1979 | Palac | 313/404 |

FOREIGN PATENT DOCUMENTS

| | | | |
|---|---|---|---|
| 2220229 | 11/1972 | Fed. Rep. of Germany | 313/402 |
| 841694 | 7/1960 | United Kingdom . | |
| 1163495 | 9/1969 | United Kingdom . | |

*Primary Examiner*—David K. Moore
*Assistant Examiner*—K. Wieder
*Attorney, Agent, or Firm*—Eugene M. Whitacre; Dennis H. Irlbeck

[57] ABSTRACT

An improvement in a cathode-ray tube having a mask-frame assembly mounted therein in spaced relation to a screen comprises the mask-frame assembly including a plurality of peripheral flexible portions, at least one of which is bridged by a member having a different coefficient of thermal expansion than the assembly.

14 Claims, 9 Drawing Figures

CATHODE-RAY TUBE HAVING A TEMPERATURE COMPENSATED MASK-FRAME ASSEMBLY

BACKGROUND OF THE INVENTION

This invention relates to cathode-ray tubes of the type having a shadow mask mounted in spaced relation to a cathodoluminescent screen, and particularly to a temperature compensating means for the shadow masks within such tubes.

Shadow mask type cathode-ray tubes usually include a screen of red, green and blue emitting phosphor lines or dots, electron gun means for exciting the screen, and a shadow mask interposed between the gun means and the screen. The shadow mask is a thin multiapertured sheet of metal precisely disposed adjacent the screen so that the mask apertures are systematically related to the phosphor lines or dots.

In shadow mask type cathode-ray tubes, the accuracy with which the electron beams strike the individual elemental screen areas depends to a great degree upon the accuracy with which the mask apertures are aligned with the elemental screen areas during operation of the tube. Thus, should the mask expand by reason of thermal effects occasioned by the impact thereon of the electron beam or beams, the resulting misalignment of the mask apertures and elemental color areas may cause at least some of the beam electrons to impinge upon elemental color areas other than the ones upon which they were intended to impinge.

Several early methods or means were proposed for compensating for thermal expansion of the mask by causing the mask to move (axially) toward the screen as it expands, outwardly to maintain the desired alignment of the mask apertures and elemental screen areas. U.S. Pat. No. 2,795,719, issued to Morrell on June 11, 1957, proposed movably mounting the mask within the envelope by means of three carriages attached to the periphery of the mask and sliding on inclined tracks mounted on the envelope. U.S. Pat. No. 2,795,718; issued to van Hekken on June 11, 1957, proposed the use of a multiplicity of flexible hinges connecting the masking member with a supporting frame, or a pivotal bell crank having arms slidably engaging the mask. These compensating means were designed primarily for use with circular masks in round tubes of moderate size and moderate deflection angle.

A later thermal compensating means was disclosed in U.S. Pat. No. 3,803,436, issued to Morrell on Apr. 9, 1974. In this patent, either a leaf spring of special shape or a combination of a box spring and a bimetallic element connected between a stud imbedded in the tube envelope and the mask is shown. Presently, most shadow mask type cathode-ray tubes use a bimetallic spring or a bimetallic element between a spring and the mask to provide for temperature compensation.

Although the foregoing patents do provide means for compensating for long-term heating of a shadow mask, they do not address the problems associated with short-term heating. Short-term heating causes doming and thus distortion of the mask shape since all portions of the mask and its associated support frame are not of uniform temperature. There are two principal methods which have been used in commercial tubes to address the short-term or doming problem. The method most widely used consists of varying the number and position of the mask-to-frame welds, such as disclosed in U.S. Pat. No. 3,368,098, issued to Demmy on Feb. 6, 1968. In another method, such as disclosed in U.S. Pat. No. 3,703,401, issued to Deal on Dec. 28, 1970, a shadow mask is coated with a material such as carbon to alter its thermal radiation characteristics.

Yet another means of compensating for doming is disclosed in U.S. Pat. No. 3,872,345, issued to Yamazaki et al. on Mar. 18, 1975. This patent shows the use of a corrugated mask surface having contiguous concave and convex areas over the apertured portion of the mask.

Although the last-named patents provide individual solutions to the long and short-term heating problems, there still is a need for additional solutions that provide the required mask compensations at potentially lower costs.

SUMMARY OF THE INVENTION

An improvement in a cathode-ray tube having a mask-frame assembly mounted therein in spaced relation to a screen comprises the mask-frame assembly including a plurality of peripheral flexible portions, at least one of which is bridged by a member having a different coefficient of thermal expansion than the assembly.

DETAILED DESCRIPTION OF THE PREFERRED EMBODIMENT

Figure 1:
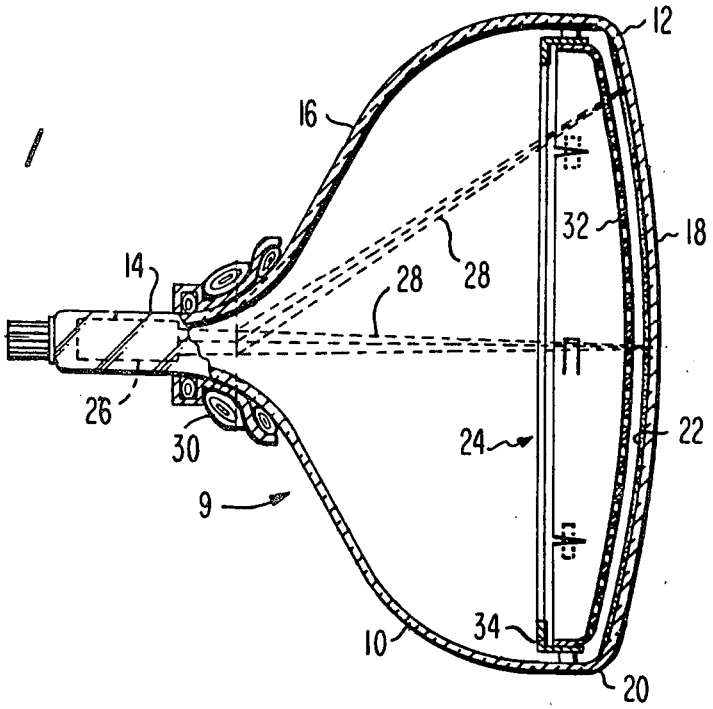
FIG. 1 is a plan view, partly in axial section, of a cathode-ray tube incorporating one embodiment of the present invention.

FIG. 1 shows an improved cathode-ray tube 9 having a glass envelope 10, comprising a rectangular faceplate panel or cap 12 and a tubular neck 14 connected by a rectangular funnel 16. The panel 12 comprises a viewing faceplate 18 and a peripheral flange or sidewall 20 which is sealed to the funnel 16. A mosaic three-color phosphor screen 22 is carried by the inner surface of the faceplate 18. The screen 22 may be either a line screen, with the phosphor lines extending substantially perpendicular to the high frequency raster line scan of the tube (normal to the plane of FIG. 1), or a dot screen. A novel shadow mask-support frame assembly 24 is removably mounted, by conventional means, in predetermined spaced relation to the screen 22. An electron gun 26, shown schematically by dotted lines in FIG. 1, is centrally mounted within the neck 14 to generate and direct three electron beams 28 along paths through a shadow mask 32 of the assembly 24 to the screen 22.

The tube 9 of FIG. 1 is designed to be used with an external magnetic deflection yoke, such as the yoke 30 schematically shown surrounding the neck 14 and funnel 16 in the neighborhood of their junction. When activated, the yoke 30 subjects the three beams 28 to vertical and horizontal magnetic fields which cause the beams to scan horizontally and vertically, respectively, in a rectangular raster over the screen 22.

Figure 2:
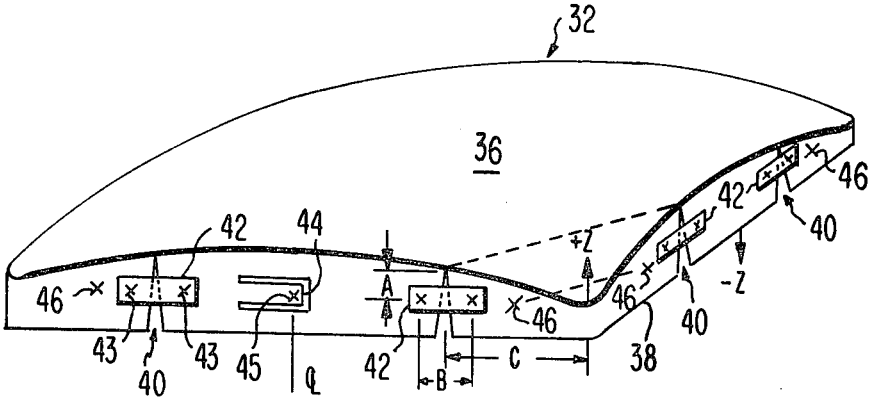
FIG. 2 is a perspective view of the shadow mask of the tube of FIG. 1.

The mask-frame assembly 24 comprises the apertured color selection electrode or shadow mask 32 supported on a peripheral frame 34. The shadow mask 32, shown in greater detail in FIG. 2, is rectangular in shape and includes an apertured active portion 36, which is substantially spherical in contour, surrounded by a peripheral skirt portion 38 which extends away from the screen 22 of the tube 9. The skirt portion 38 includes two slots 40 on each side of the rectangular mask 32, each of which is bridged by a strap member 42 having a different coefficient of thermal expansion than the mask 32. The strap members 42 are welded to the mask skirt portion 38 at each side of the slots 40 at the points 43 marked by X's on the strap members 42. The slots 40 provide the means for mask flexibility, but the strap members control the extent to which the mask flexes. Two tabs 44 (only one of which is shown in FIG. 2) are located on the skirt portion 38, each at the center of a long side of the mask 32. The tabs 44 are welded to the frame (not shown) each at the point 45 marked by an X on the tab 44 and which corresponds to a center line of the mask 32. The purpose of the tabs 44 is to prevent sidewise movement, but to permit Z-axis movement (as shown), of the mask 32. The mask skirt portion 38 also is welded to the frame 34 at the ends of each side of the mask 32 at a total of eight points 46.

In a preferred embodiment, the strap members 42 have a higher coefficient of expansion than the mask 32. Therefore, as the mask 32 and strap members 42 heat up, the strap members 42 expand the corners of the mask to rise in the +Z direction. The +Z displacement is proportional to the dimension B (as shown) and inversely proportional to the dimension A (as shown). Since the mask 32 is supported in the frame 34 at the corner points 46, as the corners go up the rest of the mask 32 goes down, in the −Z direction. This relative movement, which results in the corners of the mask 32 ending up closer to the screen than the remainder of the mask 32, is the correction necessary for some short-term heating problems caused by the central portion of the mask heating up before the peripheral portion of the mask and the frame heat up.

Figure 3:
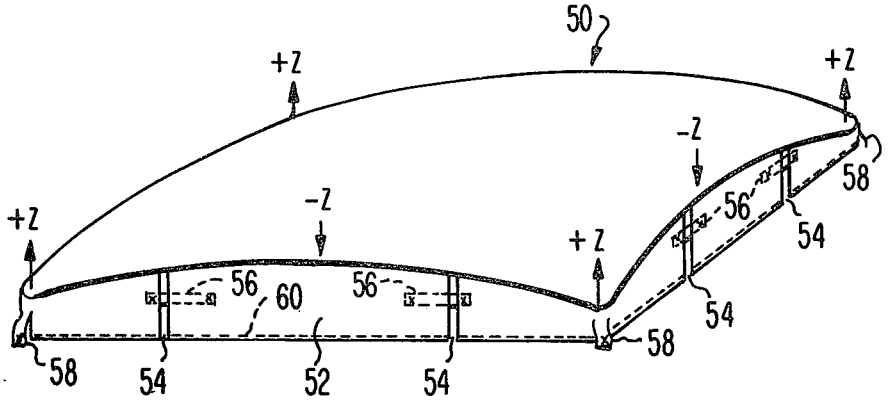
FIGS. 3, 4, 5 and 6 are perspective views of different novel shadow mask embodiments.

A second embodiment of a shadow mask 50 is shown in FIG. 3. This mask 50 has a skirt portion 52 including eight slots 54, two on each side of the mask 50. Each slot 54 is bridged on the inside of the mask 50 by an angle member 56, which is welded to the mask skirt portion 52 at each side of the slot 54. The angle members 56 have a higher coefficient of thermal expansion than the mask 50. The mask 50 includes four tabs 58, one at each corner, which are welded to a frame (not shown) at the points marked by X's on the tabs 58. The tabs 58 provide some degree of flexibility in the Z direction, but prevent sideward shifts of the mask 50. The edges 60 of the skirt portion 52 are folded back all around the skirt portion 52 to provide added strength to the mask 50. When the mask 50 is mounted to a frame, the sides of the mask skirt portions 52 are spaced from the frame and nowhere touch it.

As the mask 50 of FIG. 3 is heated, the corners of the mask 50 remain stationary and the remainder of the mask 50 moves in the −Z direction, as shown. Actual tests performed on a mask for a 25 V 110° tube indicate that points near the corners moved from 0.4 to 0.7 mils (10.2 to 17.8 microns) in the +Z direction, a point near the short sides moved from 2.1 to 2.2 mils (53.3 to 55.9 microns) in the −Z direction, and a point near the long sides moved approximately 0.3 mils (7.6 microns) in the −Z direction.

Figure 4:
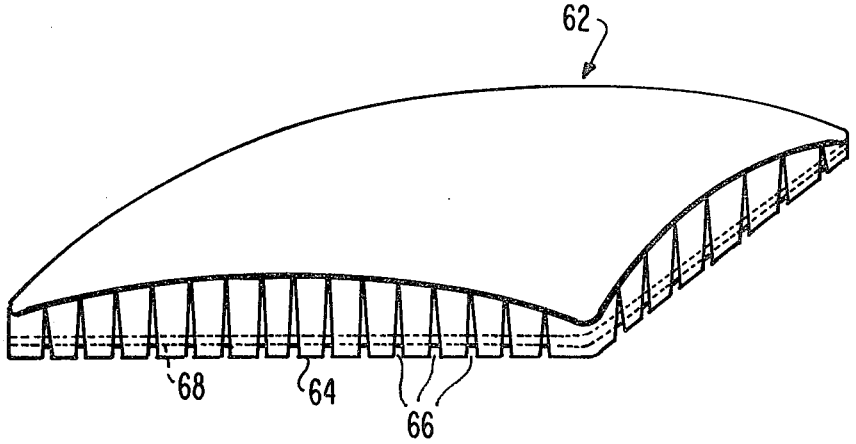

FIG. 4 shows a third embodiment of a shadow mask 62. The mask 62 has a skirt portion 64 with forty-four slots 66 spaced around the mask 62. The slots 66 are bridged by a continuous member 68 welded to the inside of the skirt portion 64. The member 68 has a different coefficient of thermal expansion than the mask 62. The attachment of the mask 62 to a frame (not shown) may be as previously shown with respect to either the mask 32 (FIG. 2) or the mask 50 (FIG. 3). The additional slots 66 in the mask 62 permit a more uniform distribution of the mask deformations.

Figure 5:
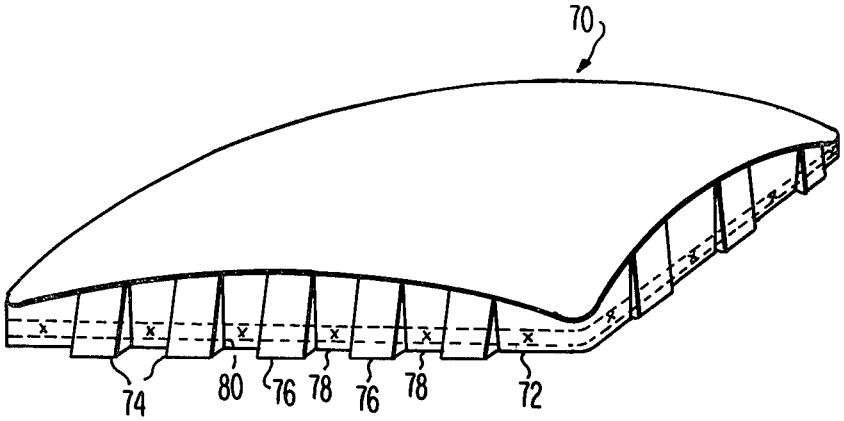

Another embodiment that permits a more uniform distribution of mask deformations is shown in FIG. 5. A mask 70 of FIG. 5 includes a skirt portion 72 having flexible flutes 74 consisting of alternate raised portions 76 and indented portions 78. The indented portions 78 are welded to a continuous strap member 80 located inside the skirt portion 72 at the points marked by X's. The strap member 80 has a different coefficient of thermal expansion than the mask 70. Again, attachment of the mask 70 to a frame (not shown) may be as previously shown with respect to either the mask 32 or the mask 50.

Figure 6:
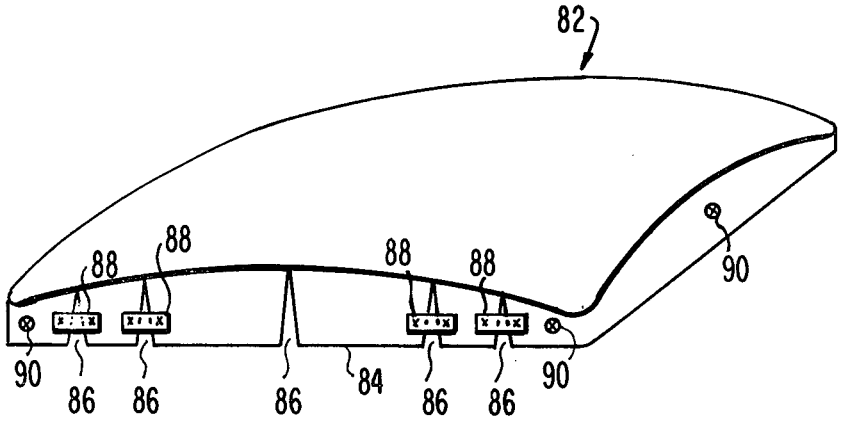

A fifth embodiment of a shadow mask 82 is shown in FIG. 6. The mask 82 has a skirt portion 84 with five slots 86 on the long sides of the mask 82 but with no slots on the short sides. The two slots 86 nearer the ends of the long sides of the mask 82 are bridged by straps 88 having a different coefficient of thermal expansion than the mask 82. The straps 88 are welded to the skirt portion 84 at opposite sides of the bridged slots 86. The central slot 86 on each long side remains unbridged. The mask 82 is welded to a frame (not shown) at the points 90 indicated by the circled X's. These points 90 are located at the ends of the long sides of the skirt portion 84 and at the centers of the short sides of the skirt portion 84. The provision of an unbridged slot 86 on each long side provides for added flexibility of the mask 82 to permit greater mask deformation. Alternately, the unbridged slots 86 of the mask 82 could be replaced with unbridged flutes to obtain similar flexibility.

Figure 7:
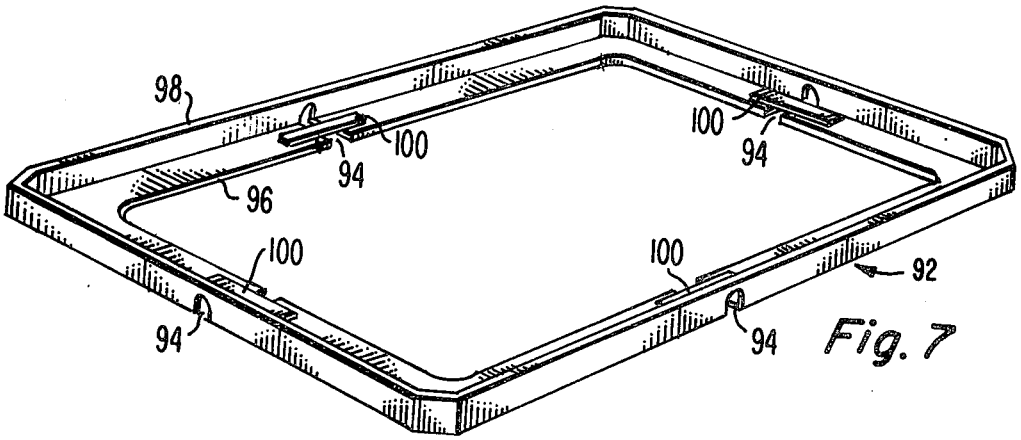
FIGS. 7 and 8 are perspective views of different novel support frame embodiments.

As an alternative to providing slots or flutes in the mask, the mask can be attached at many points to a frame 92, such as shown in FIG. 7, which includes flexible slots 94. The slots 94 in the frame 92 are located at the center of each of the sides of the frame and extend from a bottom flange 96 into a side flange 98. The slots 94 are bridged by strap members 100 having a different coefficient of thermal expansion than the frame 92. The specific mask distortion obtained from this frame embodiment depends on the coefficient of thermal expansion of the material selected for the strap members 100 compared to the coefficient of thermal expansion of the frame 92.

Figure 8:
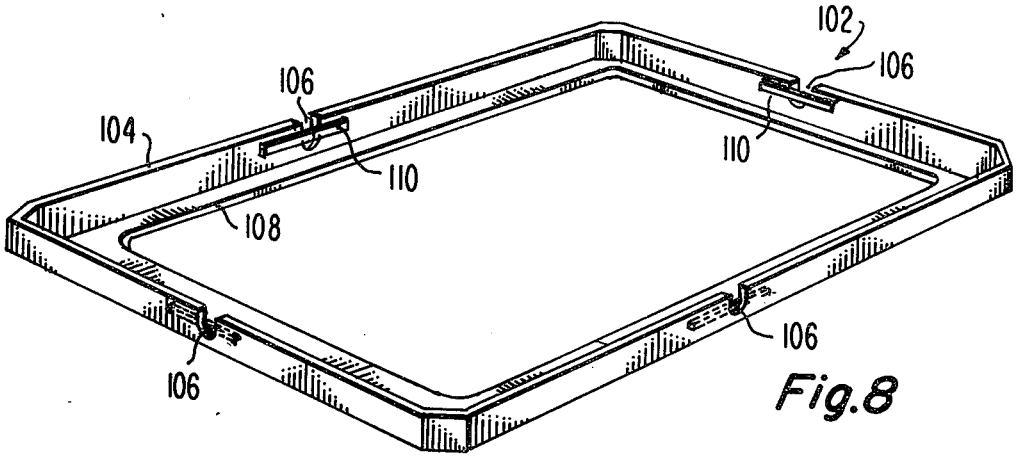

A second embodiment of a frame 102 is shown in FIG. 8. For the frame 102, the side flanges 104 include flexible slots 106 that extend to a bottom flange 108. The slots 106 are bridged by strap members 110 having a different coefficient of thermal expansion than the frame 102. Again, the specific mask distortion obtained depends on the difference in coefficients of thermal expansion between the strap members 110 and the frame 102.

Figure 9:
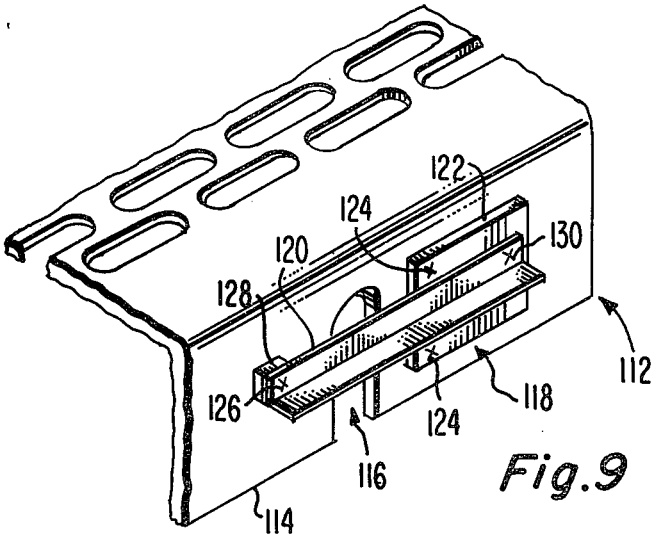
FIG. 9 is a partial perspective view of another novel shadow mask embodiment.

The members used to bridge the slots in either the mask or frame may be more complex than as previously discussed to handle more than one thermal time constant. FIG. 9 shows a portion of a mask 112 having a skirt portion 114 with a slot 116 therein. The slot 116 is bridged by a two-part member 118 comprising an angle portion 120 and a plate portion 122. The angle portion 120 and the plate portion 122 have different coefficients of thermal expansion than the mask 112. Furthermore, the angle portion 120 and the plate portion 122 have different thermal time constants than each other. The plate portion 122 is welded at points 124 close to a side of the slot 116, with the remainder of the plate portion 122 extending away from the slot 116. The angle portion 120 is attached to an opposite side of the slot 116 at a point 126 through a spacer 128, and is attached to the plate portion 122 at its far end at a point 130. In the preferred construction of the mask 112, the plate portion 122 has a high thermal inertia and, therefore, a long time constant. The angle portion 120 has a low thermal inertia and, therefore, a short time constant. As the mask 112 is heated, the angle portion 120 expands first, causing an elongation of the spacing between the points 126 and 130. Since the points 130 and 124 are connected by a plate portion 122 having a long time constant, initially there is a negligible change of spacing between these points. Therefore, there is a net change of spacing between the points 126 and 124, causing the mask 112 to flex at the slot 116. Later, as the long time constant material of the plate portion 122 heats up, there is an elongation between the points 124 and 130, which results in a closing of the spacing between the points 124 and 126 and a return of the slot 116 and mask 112 to their initial configuration.

It should be appreciated that different sizes and different types of cathode-ray tubes may require different amounts of thermal correction. Therefore, various combinations of and modifications to the foregoing embodiments may be necessary to meet these differing requirements. For example, it is contemplated that various types of bimetallic bridging straps may be useful in some embodiments. Additionally, an extension of the bridging straps used on the frames may also form a portion of a mask-frame assembly support spring.

What is claimed is:

1. In a cathode-ray tube having a mask-frame assembly mounted therein in spaced relation to a screen, said mask-frame assembly including a shadow mask attached to a peripheral frame, the improvement comprising said mask-frame assembly including a plurality of peripheral flexible portions at least one of which is bridged by a member having a different coefficient of thermal expansion than said assembly, said bridging member being attached to said assembly at opposite sides of the at least one bridged flexible portion, whereby said at least one flexible portion is caused to flex by the expansion of said bridging member when said bridging portion becomes heated during tube operation.

2. The cathode-ray tube as defined in claim 1 wherein said flexible portions include peripheral slots in the mask of said assembly.

3. The cathode-ray tube as defined in claim 1 wherein said flexible portions include peripheral flutes in the mask of said assembly.

4. The cathode-ray tube as defined in claim 1 wherein said flexible portions include slots in the frame of said assembly.

5. In a cathode-ray tube having a shadow mask mounted therein in spaced relation to a screen, said mask including an apertured central portion and a peripheral skirt portion, the improvement comprising said skirt portion including a plurality of slots extending inwardly from the outer edge of the skirt portion, at least one of said slots being bridged by a member attached to the mask at opposite sides of said one slot, and said member being of a material having a different coefficient of thermal expansion than said mask.

6. The cathode-ray tube as defined in claim 5 wherein said mask is substantially rectangular in shape and said skirt contains two said slots on each side of said mask.

7. In a cathode-ray tube having a shadow mask mounted therein in spaced relation to a screen, said mask including an apertured central portion and a peripheral skirt portion, the improvement comprising said skirt portion including a plurality of flutes with each flute being bridged by a member having a different coefficient of thermal expansion than said mask, and said bridge member being attached to said mask at opposite sides of said flutes.

8. In a cathode-ray tube having a shadow mask attached to a peripheral frame, the improvement comprising said frame including a plurality of slots extending to an edge thereof, said slots being bridged by members attached to said frame at opposite sides of said slots and said members being of a material having a different coefficient of thermal expansion than said frame.

9. In a cathode-ray tube having a shadow mask mounted therein in spaced relation to a screen, said mask including an apertured central portion and a peripheral skirt portion, the improvement comprising said skirt portion including a plurality of slots extending inwardly from an outer edge of said skirt, said slots being bridged by first members attached to said mask at one side of each of said slots and attached to second members at the other sides of said slots, said second members being attached to said mask between the locations of attachment to said first members and said slots, and said first and second members being of materials having different coefficients of thermal expansion than said mask.

10. The cathode-ray tube as defined in claim 9 wherein said first and second members have different thermal time constants than each other.

11. In a cathode-ray tube having a shadow mask mounted therein in spaced relation to a screen, said mask including an apertured central portion and a peripheral skirt portion, the improvement comprising said skirt portion including a plurality of slots extending inwardly from an outer edge of said skirt, said slots being bridged by first members attached to said mask at one side of each of said slots and attached to second members at the other sides of said slots, said second members being attached to said mask between the locations of attachment to said first members and said slots, and said first and second members being of materials having different thermal time constants.

12. In a cathode-ray tube having a shadow mask mounted therein in spaced relation to a screen, said mask including an apertured central portion and a peripheral skirt portion, the improvement comprising said skirt portion including a plurality of slots extending inwardly from the outer edge thereof, some of said slots being bridged by members attached to said mask at opposite sides of each of said some slots, said members being of a material having a different coefficient of thermal expansion than said mask, and at least one of said slots being unbridged.

13. The cathode-ray tube as defined in claim 12 wherein said mask is substantially rectangular and the long sides of said mask skirt have five said slots each, one centered and two on either side of the center slot, said center slot being unbridged and the four side slots being bridged by said members.

14. The cathode-ray tube as defined in claim 13 wherein said mask is connected to a peripheral frame at said skirt, the points of attachment being at each end of the long sides of said skirt and at the centers of the short sides thereof.

* * * * *